US009977385B2

(12) United States Patent
Miura et al.

(10) Patent No.: US 9,977,385 B2
(45) Date of Patent: May 22, 2018

(54) FIXING DEVICE AND IMAGE FORMING APPARATUS HAVING THE SAME

(71) Applicant: CANON KABUSHIKI KAISHA, Tokyo (JP)

(72) Inventors: Shusuke Miura, Toride (JP); Hiroki Kawai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/264,970

(22) Filed: Sep. 14, 2016

(65) Prior Publication Data

US 2017/0075273 A1 Mar. 16, 2017

(30) Foreign Application Priority Data

Sep. 16, 2015 (JP) ..... 2015-182895

(51) Int. Cl.
*G03G 15/00* (2006.01)
*G03G 15/20* (2006.01)

(52) U.S. Cl.
CPC ..... *G03G 15/5029* (2013.01); *G03G 15/2042* (2013.01); *G03G 15/2053* (2013.01); *G03G 2215/00734* (2013.01); *G03G 2215/2035* (2013.01)

(58) Field of Classification Search
CPC ..... G03G 15/2039; G03G 15/2042; G03G 2215/2035
See application file for complete search history.

(56) References Cited

U.S. PATENT DOCUMENTS

2007/0059001 A1* 3/2007 Matsuura ..... G03G 15/2042 399/45
2012/0308253 A1* 12/2012 Kurata ..... G03G 15/2042 399/69
2013/0142536 A1* 6/2013 Takami ..... G03G 15/2039 399/69
2013/0209123 A1* 8/2013 Waida ..... G03G 15/205 399/68

FOREIGN PATENT DOCUMENTS

JP 2001-183929 A 7/2001

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a fixing film for fixing a toner image formed on a recording material, and first and second fixing heaters configured to heat the fixing film. The first fixing heater has a high heat generation region at a center portion in a width direction of a fixing nip portion and the second fixing heater has a high heat generation region at an end portion in the width direction of the fixing nip portion. A center portion temperature detection unit detects a center portion temperature of a center portion of the fixing film in the width direction. An end portion temperature detection unit detects an end portion temperature of an end portion of the fixing film in the width direction. A size detection unit detects a size of the recording material. A control unit controls a heat generation amount of the fixing heaters.

13 Claims, 11 Drawing Sheets

FIXING DEVICE AND IMAGE FORMING APPARATUS HAVING THE SAME

BACKGROUND OF THE INVENTION

Field of the Invention

The present disclosure relates to a fixing device and an image forming apparatus having the same.

Description of the Related Art

In recent years, an electrophotographic image forming apparatus which can further improve an image quality of output images and is applicable to various types of papers is required. For example, from a relatively large-sized paper such as an A3-sized paper and the like to a small-sized paper such as an A4R-sized paper and a B5-sized paper, which are commonly used, it is required to output paper of various sizes in the electrophotographic image forming apparatus.

In the electrophotographic image forming apparatus, a film heating fixing system is generally known. The film heating fixing system is a system through which a toner image formed on a paper as a recording material is heated via a fixing film to fix the toner on the paper. A film heating fixing system fixing device forms a fixing nip portion between the fixing film and a pressurizing roller by interposing a heat-resistant film (fixing film) between a fixing heater as a heat generating body and a pressurizing rotating member (pressurizing roller). When the fixing heater is energized, the fixing heater generates heat and the fixing film is heated from a back side. Further, the fixing nip portion is heated. When rotating the pressurizing roller, the fixing film is driven to rotate, which enables to convey a paper entering into the fixing nip portion. In this manner, it is possible to keep the fixing nip portion at a constant temperature while forming an unfixed toner image, heating and conveying the paper entering into the fixing nip portion, and fixing the unfixed toner image as a permanent image.

In the film heating fixing system, it is required to stabilize the fixing nip portion at a predetermined temperature with respect to various types of paper. However, with the above configuration, in a case where the small-sized paper passes through the fixing nip portion, a non-paper passing region is generated at an end portion in a width direction of the fixing nip portion even though it is a heat generating region. It is noted that the width direction means a direction which is orthogonal to a paper conveying direction.

In the non-paper passing region, heat is not taken at the fixing nip portion so that the temperature becomes very high (local temperature rise). If the local temperature rise becomes large, thermal damage is easily given to each member so that it is required to prevent an excessive local temperature rise.

As one method to prevent the local temperature rise, when an end portion temperature becomes at a fixed temperature or higher, paper passing is temporarily stopped until the temperature falls by heat radiation. However, with this method, a downtime is caused by the stop of the paper passing, which causes a reduction in productivity.

Further, when passing a paper whose width in a width direction is wide, due to an influence of the heat radiation from the end portion, a region where the temperature drops is generated at the end portion of a paper passing region. When the region of low temperature is generated, toner fixability is deteriorated and density unevenness of the output image becomes large.

On the contrary, a conventional image forming apparatus according to Japanese Patent Application Publication Laid-open No. 2001-183929 comprises heat generating bodies of different heat generation amount in a width direction of the fixing device and one or more temperature sensors in the width direction. Due to this, in accordance with a temperature difference in the width direction measured by the temperature sensor, the conventional image forming apparatus controls an energization ratio of each heat generating body to maintain productivity while reducing temperature unevenness.

However, in the conventional image forming apparatus, control in accordance with the paper size and a heat generation amount distribution of the heater is not performed. Instead, control is performed only by the temperature. Thereby, in the conventional image forming apparatus, optimum control is not performed, which requires to further reduce the local temperature rise of the fixing film and the temperature unevenness in the width direction of the paper passing region.

For example, using a heater whose heat generation amount orientation is uniform in the width direction, a temperature distribution of the fixing film is shown in FIG. 11 and FIG. 12. FIG. 11 shows the temperature distribution of the fixing film in a case where the A4R-sized paper is continuously passed. FIG. 12 shows the temperature distribution of the fixing film in a case where an SRA3-sized paper is continuously passed. FIG. 11 shows that the temperature of the fixing film locally rises 70° C. with respect to the temperature of the paper passing region. Further, FIG. 12 shows that the temperature of the end portion of the paper passing region is reduced 20° C. as compared to that of a center portion.

Contrary to this, using a heater A and a heater B having the heat generation amount orientation as shown in FIG. 13, the energization ratio of each heater is determined based on the temperature difference between the center portion temperature and the end portion temperature. FIG. 14 shows the temperature distribution in a case where the A4R-sized paper is continuously passed in this case. FIG. 15 shows the temperature distribution in a case where the SRA3-sized paper is continuously passed in this case. It is obvious in FIG. 14 that the local temperature rise with respect to the paper passing region is reduced to 30° C., however, it is obvious that this can further be reduced. Further, in FIG. 15, a temperature drop at the end portion of the paper passing region with respect to the center portion is improved to 10° C., however, it is obvious that this can further be improved.

In view of the above problems, the present disclosure mainly intends to provide an image forming apparatus which reduces the local temperature rise of the fixing film and the temperature unevenness in the width direction of the paper passing region.

SUMMARY OF THE INVENTION

According to the present disclosure, an image forming apparatus comprises: a fixing film for heating a toner image formed on a recording material to be fixed by heat; a first fixing heater, having a high heat generating region at a center portion, configured to heat the fixing film and; a second fixing heater, having a high heat generating region at an end portion, configured to heat the fixing film and; a center portion temperature detection unit configured to detect a temperature of a center portion of the fixing film; an end portion temperature detection unit configured to detect a temperature of an end portion of the fixing film; a size detection unit configured to detect a size of the recording material; and a control unit configured to control a heat generation amount of the first fixing heater and the second fixing heater based on the temperature detected by the center portion temperature detection unit, the temperature detected by the end portion temperature detection unit, and the size of the recording material detected by the size detection unit.

Further features of the present invention will become apparent from the following description of exemplary embodiments (with reference to the attached drawings).

DESCRIPTION OF THE EMBODIMENTS

In the following, embodiments of the image forming apparatus according to the present invention are described with reference to the drawings. The image forming apparatus which is applicable to the present disclosure forms a latent image corresponding to image information signals by an electrophotographic system, an electrostatic recording system and the like on an image carrier such as photoreceptors, dielectrics and the like. Then, the image forming apparatus develops the latent image by a developing device using a two-component developer using a toner particle and a carrier particle as main components to form visible images (toner images). Then, the image forming apparatus transfers the visual images to a transfer material such as a paper. Then, the transferred images are made into permanent images by the fixing unit. The image forming apparatus with the above configuration can be applied to the present disclosure.

Figure 1:
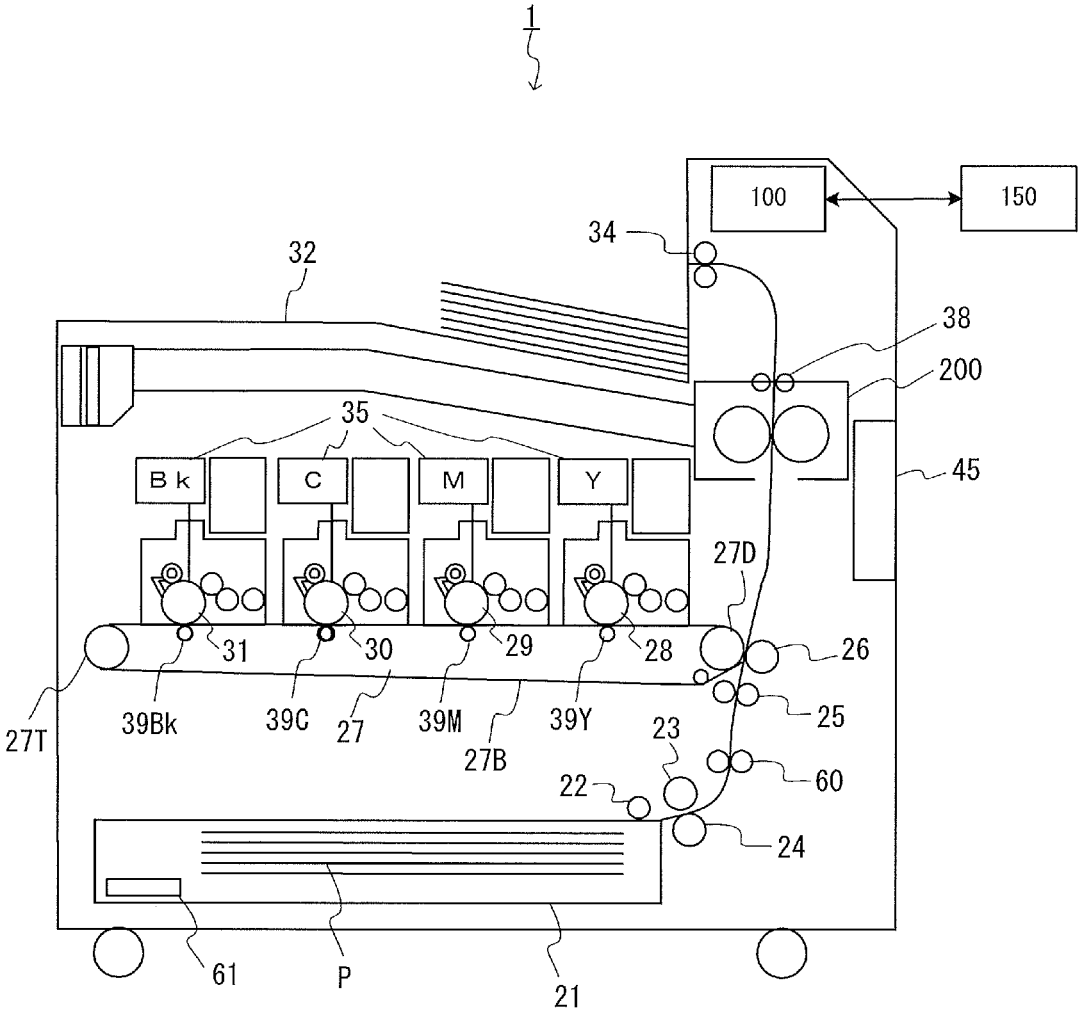
FIG. 1 is a schematic longitudinal cross-sectional view showing an example of a configuration of an image forming apparatus.

FIG. 1 is a schematic longitudinal cross-sectional view showing an example of a configuration of an image forming apparatus according to the present embodiment. In the present embodiment, a description is provided in a case where the present disclosure is applied to an electrophotographic digital copying machine. It is needless to say, however, that the present disclosure can equally be applied to other various image forming apparatuses including the electrophotographic image forming apparatus and the image forming apparatus of the electrostatic recording system.

An image forming apparatus 1 shown in FIG. 1 is an electrophotographic printer, which can form a full color image on a recording material and output the image by performing image forming operation in accordance with image information input from an external host device 150 which is communicably connected to a control circuit part 100, described later (control board: CPU).

The external host device 150 is a computer, an image reader, and the like. The control circuit part 100 exchanges signals with the external host device 150. Further, the control circuit part 100 exchanges signals with a various image forming devices and controls an image forming sequence.

The image forming apparatus 1 comprises a paper feeding cassette 21 for storing a paper P as the recording material, photosensitive drums 28 to 31, a size detection unit 61, a pickup roller 22, a feed roller 23, a retard roller 24, registration roller pairs 25, and an intermediate transfer unit 27. The image forming apparatus 1 also comprises a driving roller 27D, a tension roller 27T, a paper delivery tray 32, paper delivery roller pairs 34, a laser scanner 35, conveyance roller pairs 60, and a fixing device 200. The driving roller 27D and the tension roller 27T stretch an endless belt of an intermediate transfer belt 27B. The driving roller 27D is brought into contact with a secondary transfer roller 26 through the intermediate transfer belt 27B. Each of primary transfer rollers 39Bk, 39C, 39M, and 39Y is pressurized to the belt side through a spring (not shown).

The photosensitive drums 28 to 31 as the image carrier is attachably/detachably held to/from the apparatus main body in a central axis direction of the photosensitive drum by opening an opening/closing member which also functions as an exterior. The laser scanner 35 exposes a surface of the photosensitive drum. By opening a fixing door 45, the fixing device 200 is attachably/detachably held to/from the apparatus main body in a right direction when viewed from front of FIG. 1.

When performing image formation in the image forming apparatus 1, first, several sheets of the paper P are conveyed from the paper feeding cassette 21 by the pickup roller 22. Then, the several sheets of the paper P are separated one by one by the retard roller 24. Thereafter, the paper P is conveyed to the registration roller pairs 25 by the conveyance roller pairs 60. The paper P temporarily stops here.

The latent image formed on the photosensitive drums 28 to 31 by the exposure by the laser scanner 35 is developed by the developing device with toner. Thereafter, the toner image is primarily transferred to the endless belt of the intermediate transfer belt 27B. The toner image which is primarily transferred to the intermediate transfer belt 27B proceeds to the secondary transfer roller 26. Then, in accordance with the toner image, conveyance of the paper P, which temporarily stopped at the registration roller pairs 25, is restarted. Then, the toner image is transferred to the paper P by the secondary transfer roller 26. The paper P on which an unfixed toner image is carried (unfixed toner image T in FIG. 3, which is described later) is heated and pressurized by the fixing device 200. In this manner, the unfixed toner image is fixed on the paper P. The paper P on which the toner image is fixed passes through a fixing downstream part conveyance roller pairs 38 in a paper conveying direction. Thereafter, the paper P is delivered on the paper delivery tray 32 by the paper delivery roller pairs 34. Next, a description is provided in detail with regard to a configuration of the fixing device 200 using FIG. 2 and FIG. 3.

Figure 2:
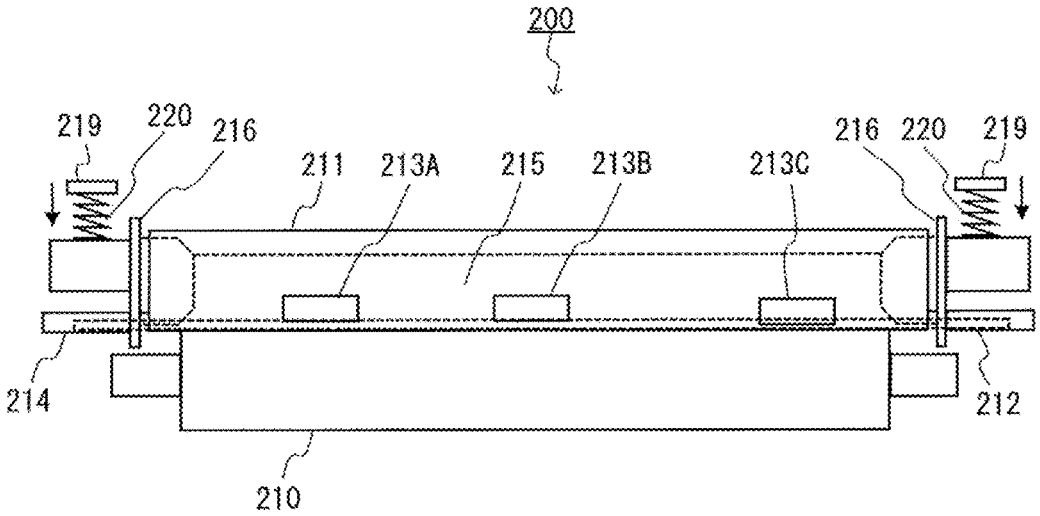
FIG. 2 is a schematic top view showing an example of a configuration of a fixing device.
Figure 3:
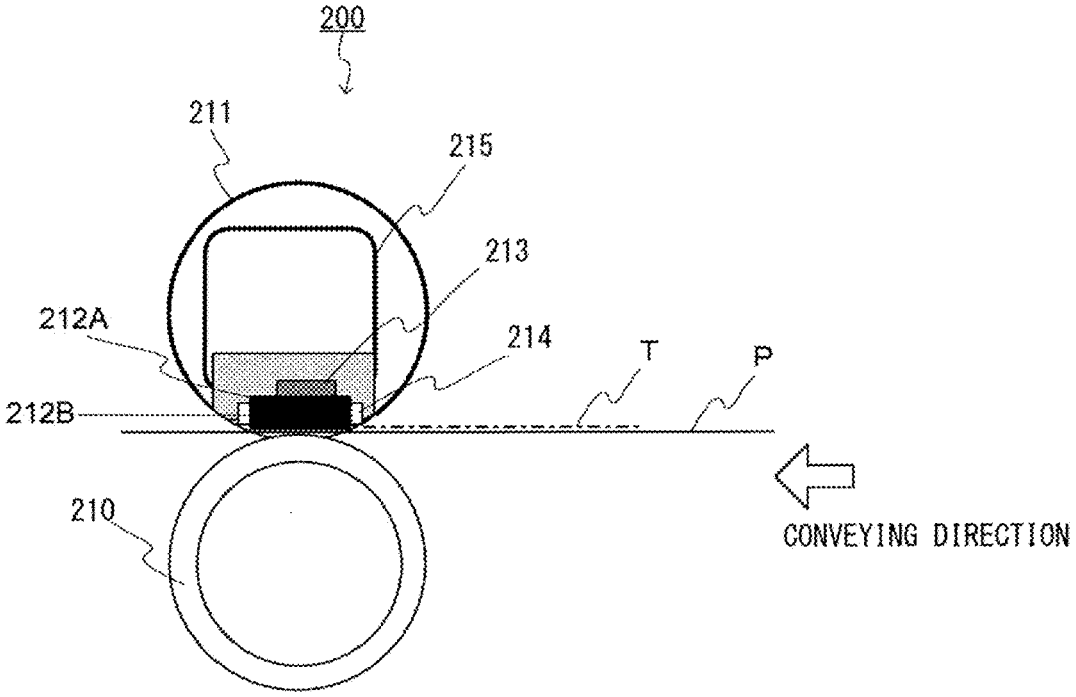
FIG. 3 is a schematic longitudinal cross-sectional view showing an example of a configuration of the fixing device.

FIG. 2 is a schematic top view showing an example of the configuration of the fixing device 200. FIG. 3 is a schematic longitudinal cross-sectional view showing an example of the configuration of the fixing device 200. The fixing device 200 is a film type image heating device comprising a pressurizing roller 210, a fixing film 211, and a ceramic heater (hereinafter, referred to as "heater") 212. A width direction used when explaining the fixing device 200 and members constituting the same means a direction which is orthogonal to a sheet conveying direction.

The heater 212 shown in FIG. 3 is a heating body, which basically comprises a ceramic substrate and an energization heat generating resistor layer provided on a surface of the substrate. The ceramic substrate has a long and narrow thin plate shape which extends toward the width direction of the fixing device 200. The heater 212 is a heater of low heat capacity which rises temperature entirely with steep rising characteristics by energizing the heat generating resistor layer. The heater 212 comprises a first fixing heater 212A (a first heater 212A) and a second fixing heater 212B (a second heater 212B), which are arranged in parallel. The first heater 212A has a high heat generating region at a center portion where the heat generation amount is high. The second heater 212B has a low heat generating region at a center portion where the heat generation amount is low.

Figure 13:
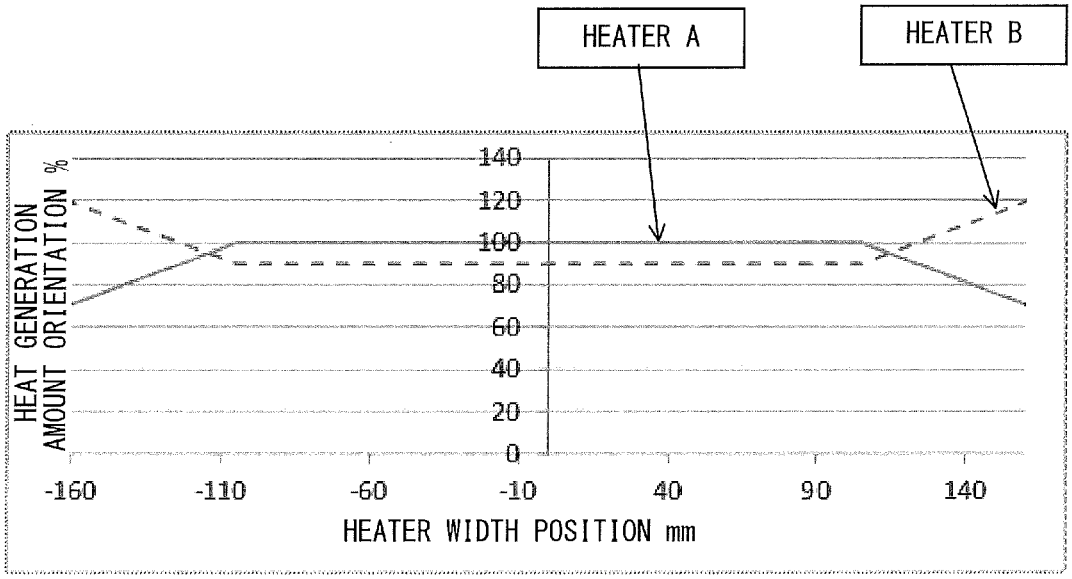
FIG. 13 is a diagram for explaining the heat generation amount orientation of a heater whose heat generation amount orientation is not uniform in the width direction.

It means that the first heater 212A and the second heater 212B are heaters respectively having different heat gradient in the width direction, like the heater A and the heater B as shown in FIG. 13. The first heater 212A has a feature that it has a maximum heat gradient near a center portion in the width direction and the heat gradient falls toward both end portions in the width direction. On the other hand, the second heater 212B has a feature that it has the maximum heat gradient at the both end portions in the width direction and the heat gradient falls toward the center portion in the width direction. By controlling heating operation of the two heaters, it is possible to cope with the temperature unevenness caused in the width direction.

On a back side (back surface) of the heater 212A, a thermistor 213A which operates as a first temperature sensor, a thermistor 213B which operates as a second temperature sensor, and a thermistor 213C which operates as a third temperature sensor are respectively arranged in order along an orthogonal direction of the conveying direction of the paper P. Further, when supplying power, the heater 212 generates heat to heat the fixing film 211 from inside. Signals relating to the temperature detected through each thermistor are input into the control circuit part 100 as detected temperature information. The control circuit part 100 controls an energization amount of the heater 212 such that the detected temperature information input from each thermistor is maintained at a predetermined fixing temperature. Note that, based on where to detect the temperature, each temperature detection unit of the thermistors 213A, 213B, and 213C is sometimes referred to as a front end portion temperature detection unit 213A, a center portion temperature detection unit 213B, and a deep end portion temperature detection unit 213C in order. Further, each thermistor is arranged so that an interval between the thermistor 213A and the thermistor 213B is shorter than the interval between the thermistor 213B and the thermistor 213C.

Figure 4:
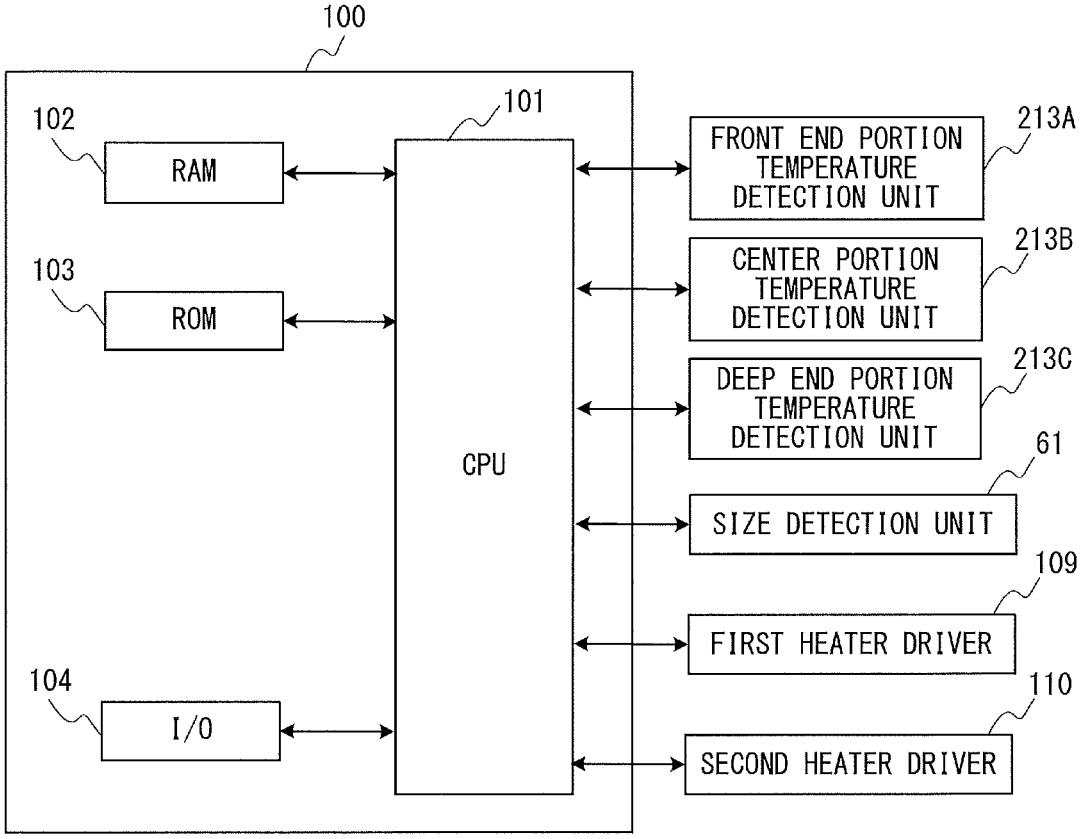
FIG. 4 is a control block diagram for explaining an example of a functional configuration of the image forming apparatus.

FIG. 4 is a control block diagram for explaining an example of a functional configuration of an image forming apparatus 1. The control circuit part 100 comprises a central processing unit (CPU) 101, a random access memory (RAM) 102, a read only memory (ROM) 103, and an input/output (I/O) 104.

The CPU 101 reads a control program stored in the ROM 103 and data stored in the RAM 102 according to signals input into the I/O 104. Then, in accordance with an output value of each temperature detection unit (213A, 213B, 213C) and an output value of the size detection unit 61, the CPU 101 energizes the first heater 212A and the second heater 212B. The first heater 212A and the second heater 212B are energized through a first heater driver 109 and a second heater driver 110.

Figure 5:
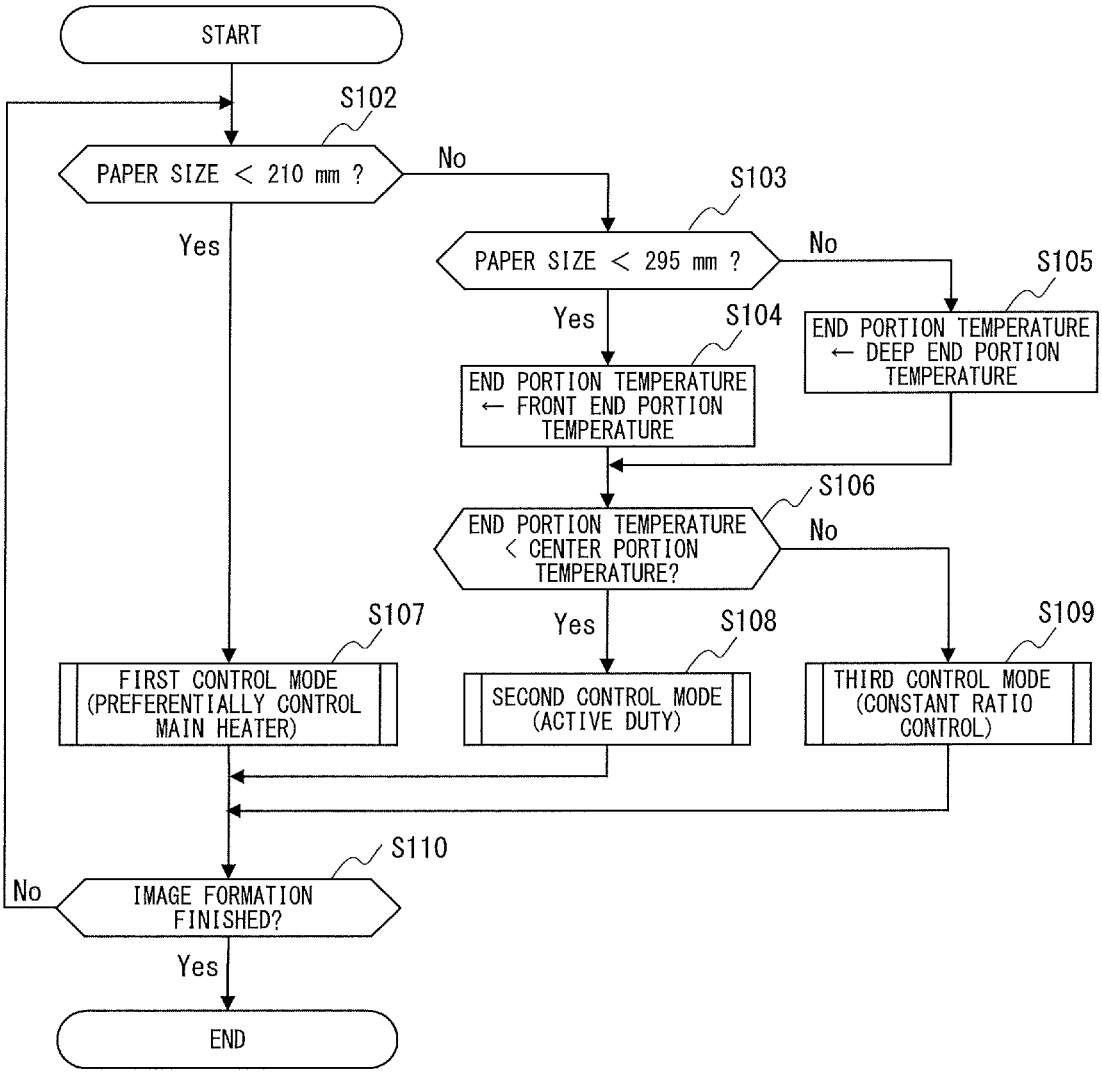
FIG. 5 is a flowchart showing an example of temperature control procedure of the fixing device.

FIG. 5 is a flowchart showing an example of temperature control procedure of the fixing device 200. Each processing shown in FIG. 5 is mainly executed by the CPU 101.

When the image forming apparatus 1 is powered ON, when a print job is received through the I/O 104 by the user's input, the CPU 101 reads a supplement control program stored in the ROM 103 and starts a fixing heater control program.

Based on the output value of the size detection unit 61, the CPU 101 determines whether the paper size (the width of the paper P) is smaller than 210 mm or not (Step S102). If it is determined that the paper size is smaller than 210 mm (Step S102: Yes), the CPU 101 starts a first control mode through which the first heater 212A is preferentially heated (Step S107). The detail of the first control mode is described later.

If it is determined that the paper size is equal to or wider than 210 mm (Step S102: No), the CPU 101 determines whether the paper size is smaller than 295 mm or not (Step S103). If it is determined that the paper size is smaller than 295 mm (Step S103: Yes), the CPU 101 determines a front end portion temperature detected by the front end portion temperature detection unit 213A as an end portion temperature (Step S104). Further, if it is determined that the paper size is equal to or wider than 295 mm (Step S103: No), the CPU 101 determines a deep end portion temperature detected by the deep end portion temperature detection unit 213C as the end portion temperature (Step S105).

The CPU 101 determines whether the end portion temperature is lower than a center portion temperature or not (Step S106). If it is determined that the end portion temperature is lower than the center portion temperature (Step S106: Yes), the CPU 101 starts a second control mode through which the second heater 212B is preferentially heated (Step S108). The detail of the second control mode is described later. If it is determined that the end portion temperature is equal to or higher than the center portion temperature (Step S106: No), the CPU 101 starts a third control mode through which a heat generation amount of the second heater 212B is reduced (Step S109). The detail of the third control mode is described later.

After one of the processing of the first control mode in the Step S107, the second control mode in the Step S108, or the third control mode in the Step S109 is finished, the CPU 101 determines whether the image formation is finished or not (Step S110). If it is determined that the image formation is finished (Step S110: Yes), the CPU 101 ends a series of processing. If not (Step S110: No), the CPU 101 returns to the processing of the Step S102. In the following, descriptions are provided with regard to each control mode, i.e., the first control mode, the second control mode, and the third control mode.

Figure 6:
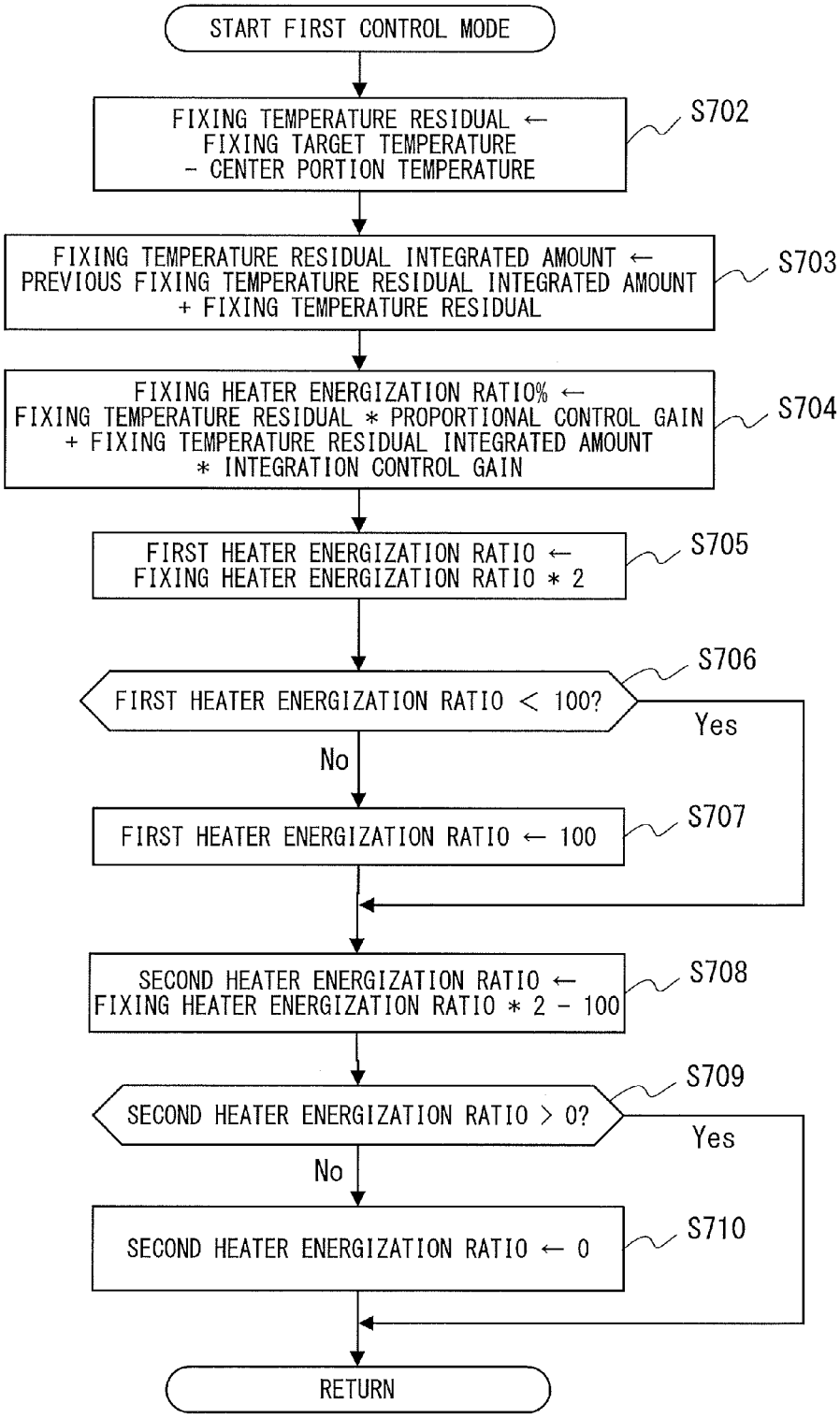
FIG. 6 is a flowchart showing an example of processing of a first control mode of a Step S107.

FIG. 6 is a flowchart showing an example of the processing of the first control mode of the Step S107. The CPU 101 starts the first control mode. The CPU 101 defines a value obtained by subtracting a center portion temperature from a fixing target temperature as a fixing temperature residual (Fixing temperature residual=Fixing target temperature−Center portion temperature) (Step S702). The CPU 101 defines a value obtained by adding a previous fixing temperature residual integrated amount to the fixing temperature residual as a fixing temperature residual integrated amount (Fixing temperature residual integrated amount=Previous fixing temperature residual integrated amount+Fixing temperature residual) (Step S703). The calculation result is stored, for example, in a storage unit (not shown).

The CPU 101 defines a value obtained by adding a value obtained by multiplying the fixing temperature residual by a proportional gain (proportional control gain) to a value obtained by multiplying the fixing temperature residual integrated amount by an integration gain (integration control gain) as a fixing heater energization ratio (Fixing heater energization ratio %=Fixing temperature residual*Proportional control gain+Fixing temperature residual integrated amount*Integration control gain) (Step S704). In this manner, the CPU 101 determines the fixing heater energization ratio through PI control in accordance with the fixing temperature residual. The CPU 101 defines a value obtained by multiplying the fixing heater energization ratio by 2 (doubled value of the fixing heater energization ratio) as a first heater energization ratio (First heater energization ratio=Fixing heater energization ratio*2) (Step S705).

The CPU 101 determines whether the first heater energization ratio is smaller than 100 or not (Step S706). If it is determined that the first heater energization ratio is equal to or more than 100 (Step S706: No), the CPU 101 sets the first heater energization ratio to 100 (Step S707). If it is determined that the first heater energization ratio is smaller than 100 (Step S706: Yes), the CPU 101 defines a value obtained by subtracting 100 from a value obtained by multiplying the fixing heater energization ratio by 2 as a second heater energization ratio (Second heater energization ratio=Fixing heater energization ratio*2−100) (Step S708).

The CPU 101 determines whether the second heater energization ratio is larger than 0 (zero) or not (Step S709). If it is determined that the second heater energization ratio is equal to or less than 0 (zero) (Step S709: No), the CPU 101 sets the second heater energization ratio to 0 (zero) (Step S710). Thereafter, the CPU 101 finishes the first control mode and returns to the processing of the Step S110 (FIG. 5). Further, if it is determined that the second heater energization ratio is larger than 0 (zero) (Step S709: Yes), the CPU 101 finishes the first control mode and returns to the processing of the Step S110 (FIG. 5).

Figure 7:
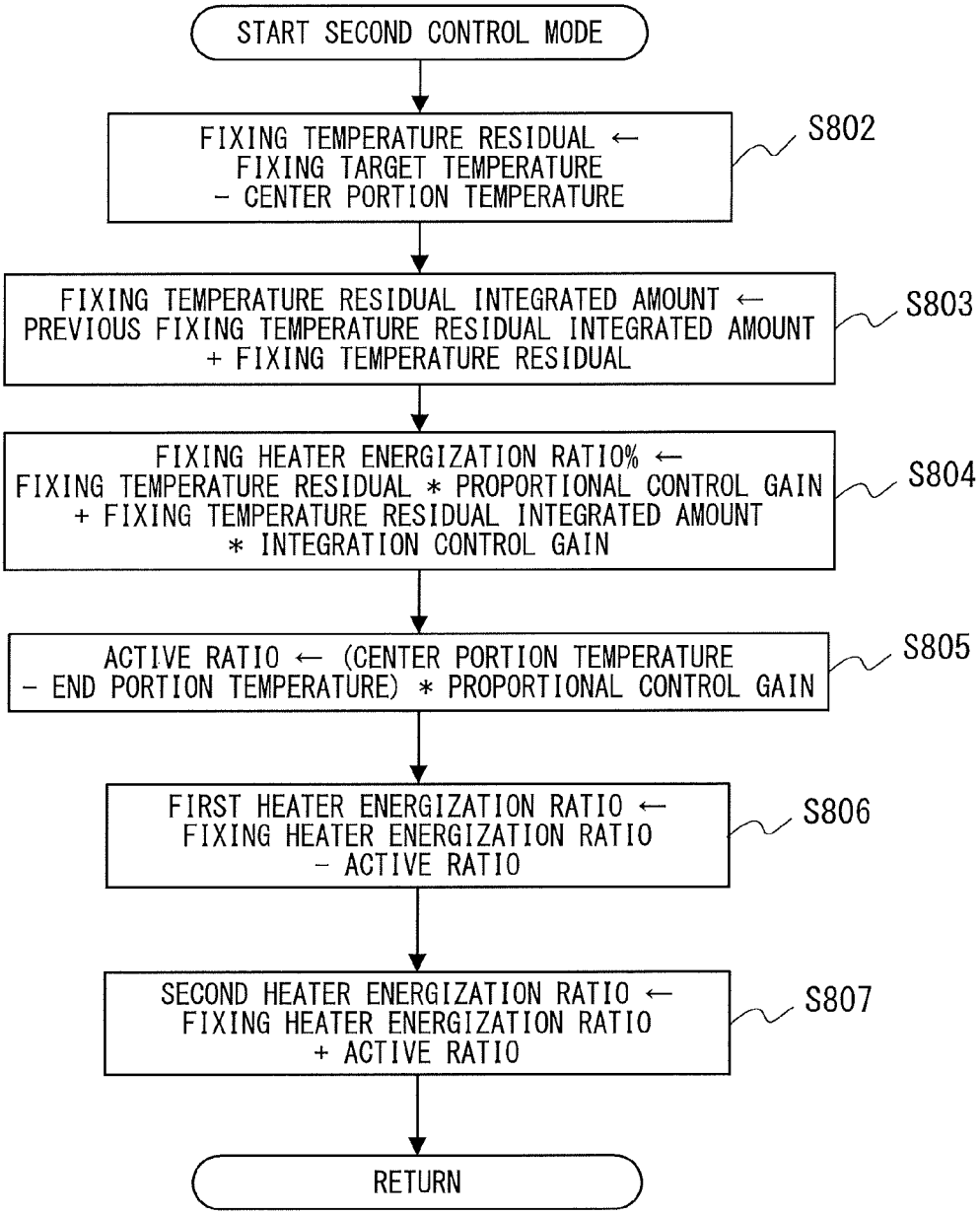
FIG. 7 is a flowchart showing an example of processing of a second control mode of a Step S108.

FIG. 7 is a flowchart showing an example of the processing of the second control mode of the Step S108. The CPU 101 starts the second control mode. The CPU 101 defines a value obtained by subtracting a center portion temperature from a fixing target temperature as a fixing temperature residual (Fixing temperature residual=Fixing target temperature−Center portion temperature) (Step S802). The CPU 101 defines a value obtained by adding a previous fixing temperature residual integrated amount to the fixing temperature residual as a fixing temperature residual integrated amount (Fixing temperature residual integrated amount=Previous fixing temperature residual integrated amount+Fixing temperature residual) (Step S803). The calculation result is stored, for example, in a storage unit (not shown).

The CPU 101 defines a value obtained by adding a value obtained by multiplying the fixing temperature residual by a proportional control gain to a value obtained by multiplying the fixing temperature residual integrated amount by an integration control gain as a fixing heater energization ratio (Fixing heater energization ratio %=Fixing temperature residual*Proportional control gain+Fixing temperature residual integrated amount*Integration control gain) (Step S804). The CPU 101 defines a value obtained by multiplying a value obtained by subtracting an end portion temperature from the center portion temperature by a proportional control gain as an active ratio (Active ratio=(Center portion temperature−End portion temperature)*Proportional control gain) (Step S805).

The CPU 101 defines a value obtained by subtracting the active ratio from the fixing heater energization ratio as a first heater energization ratio (First heater energization ratio=Fixing heater energization ratio−Active ratio) (Step S806). The CPU 101 defines a value obtained by adding the fixing heater energization ratio to the active ratio as a second heater energization ratio (Second heater energization ratio=Fixing heater energization ratio+Active ratio) (Step S807). Then, the CPU 101 finishes the second control mode and returns to the processing of the Step S110 (FIG. 5).

Figure 8:
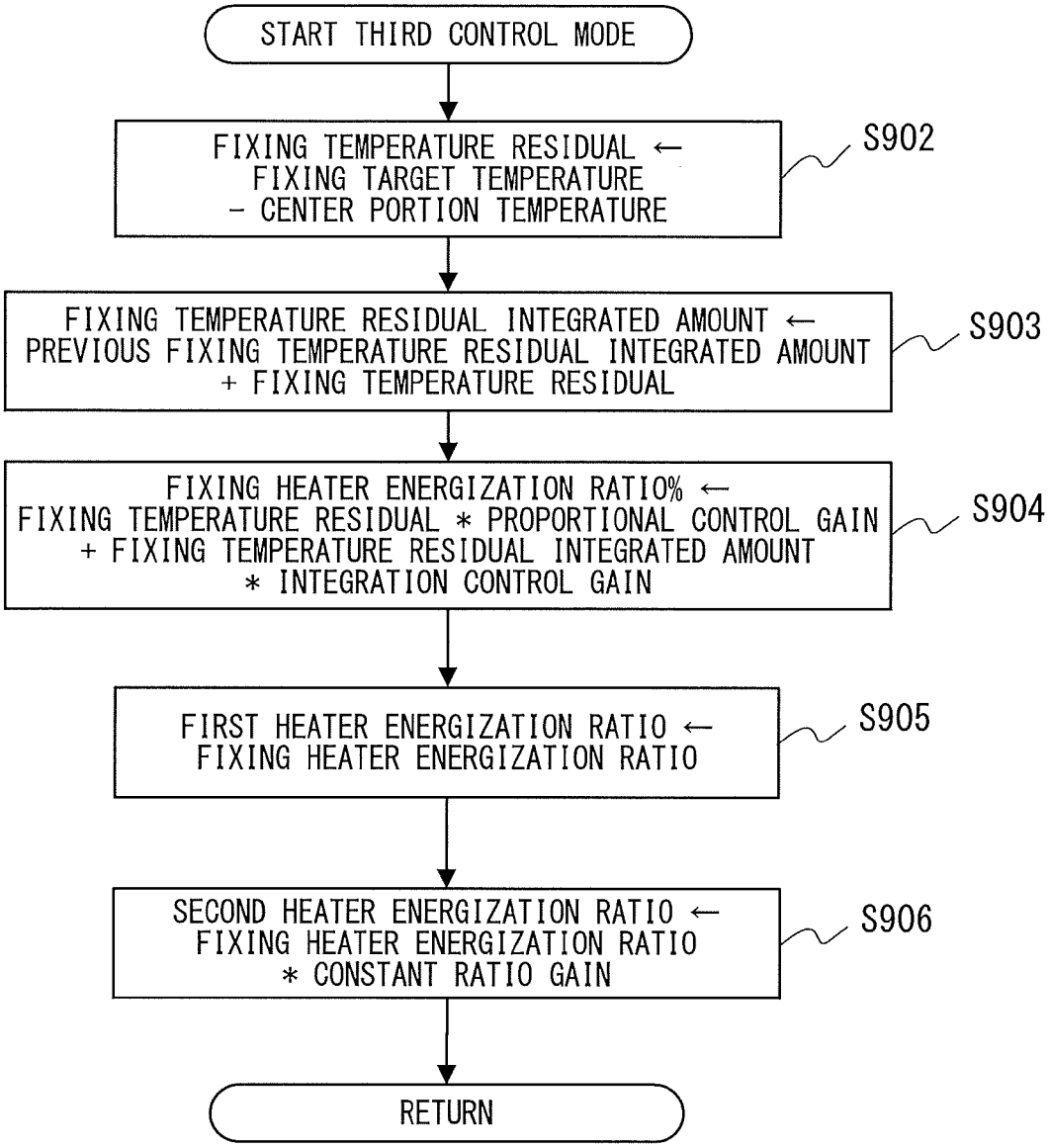
FIG. 8 is a flowchart showing an example of processing of a third control mode of a Step S109.

FIG. 8 is a flowchart showing an example of the processing of the third control mode of the Step S109. The CPU 101 starts the third control mode. The CPU 101 defines a value obtained by subtracting a center portion temperature from a fixing target temperature as a fixing temperature residual (Fixing temperature residual=Fixing target temperature−Center portion temperature) (Step S902). The CPU 101 defines a value obtained by adding a previous fixing temperature residual integrated amount to the fixing temperature residual as a fixing temperature residual integrated amount (Fixing temperature residual integrated amount=Previous fixing temperature residual integrated amount+Fixing temperature residual) (Step S903). The calculation result is stored, for example, in the storage unit (not shown).

The CPU 101 defines a value obtained by adding a value obtained by multiplying the fixing temperature residual by a proportional control gain to a value obtained by multiplying the fixing temperature residual integrated amount by an integration control gain as a fixing heater energization ratio (Fixing heater energization ratio %=Fixing temperature residual*Proportional control gain+Fixing temperature residual integrated amount*Integration control gain) (Step S904). The CPU 101 defines the fixing heater energization ratio as a first energization ratio (Step S905). The CPU 101 defines a value obtained by multiplying the fixing heater energization ratio by a constant ratio gain as a second energization ratio (Second heater energization ratio=Fixing heater energization ratio*Constant ratio gain) (Step S906).

Then, the CPU 101 ends the third control mode and returns to the processing of the Step S110 (FIG. 5). Next, a description is provided with regard to the temperature distribution of the fixing film of the image forming apparatus 1.

Figure 9:
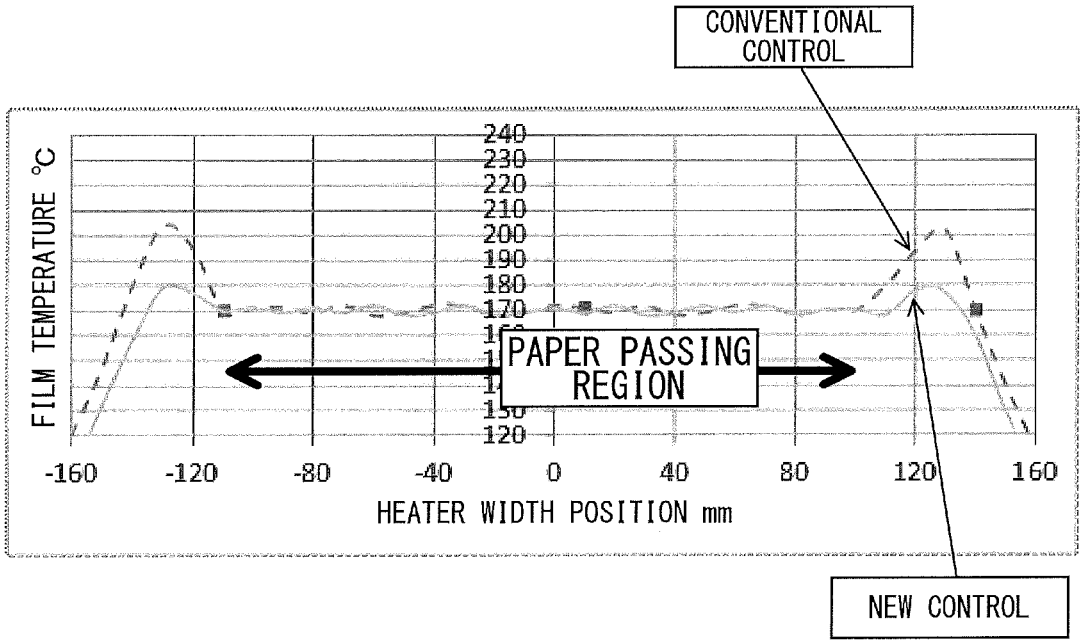
FIG. 9 is a diagram for explaining an example of the temperature distribution of the fixing film in a case where the A4R-sized paper is continuously passed.

FIG. 9 is a diagram for explaining an example of the temperature distribution of the fixing film in a case where the A4R-sized paper is continuously passed. FIG. 9 shows the temperature distribution of the fixing film through the conventional-type control (conventional control) and the temperature distribution of the fixing film through the control of the image forming apparatus 1 (new control), in which the temperature distribution of the fixing film through the conventional control can be compared with that through the new control.

Figure 14:
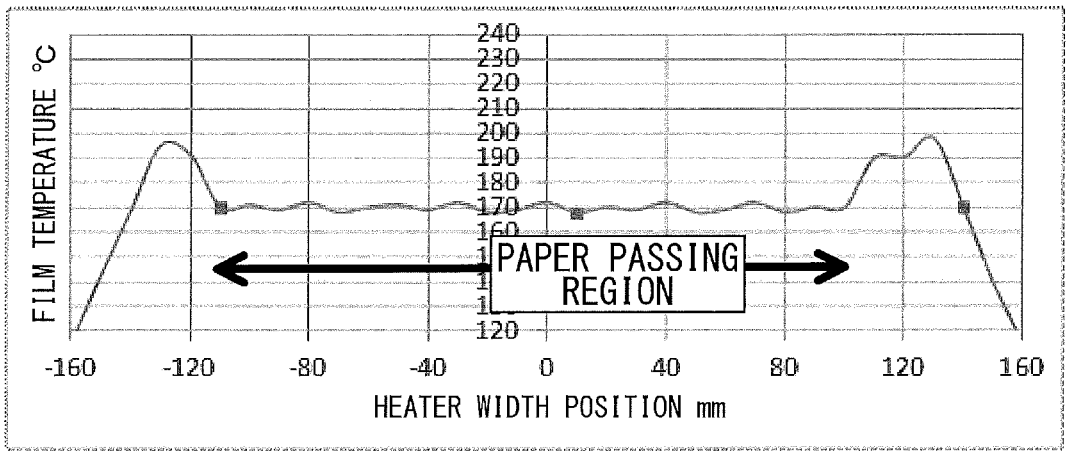
FIG. 14 is a diagram for explaining the temperature distribution of the fixing film in a case where the A4R-sized paper is continuously passed in the image forming apparatus comprising a heater whose heat generation amount orientation is not uniform in the width direction and which applies the conventional control.

In a graph shown in FIG. 9, a local temperature rise through the conventional control is about 30° C. (see FIG. 14). On the contrary, it is obvious that the local temperature rise is reduced to about 10° C. through the control performed by the image forming apparatus 1.

Figure 10:
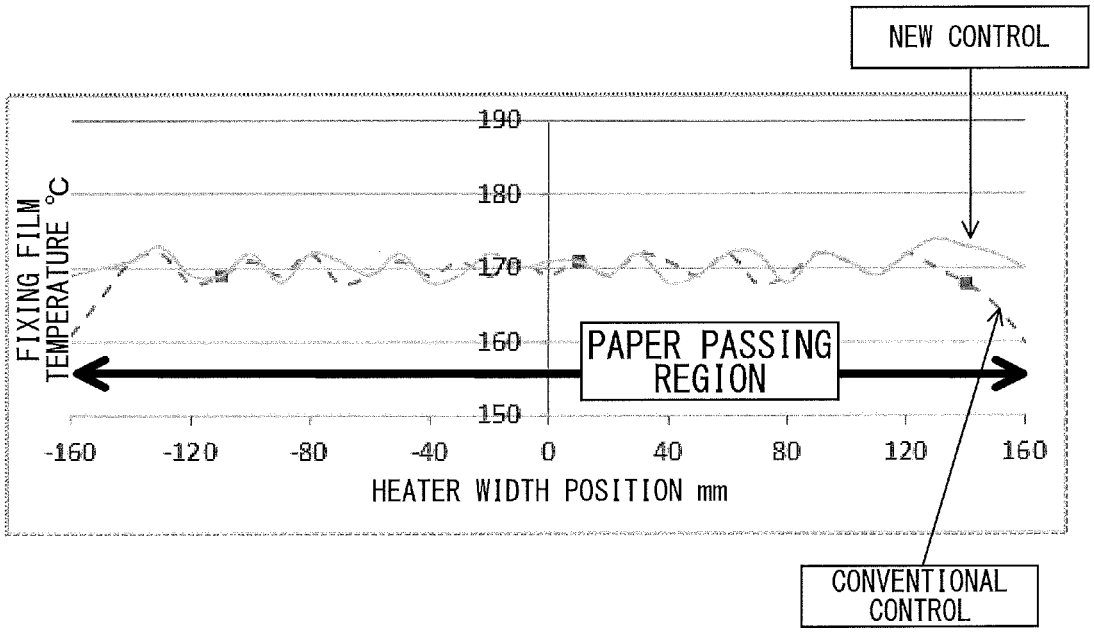
FIG. 10 is a diagram for explaining an example of the temperature distribution of the fixing film in a case where the SRA3-sized paper is continuously passed.
Figure 11:
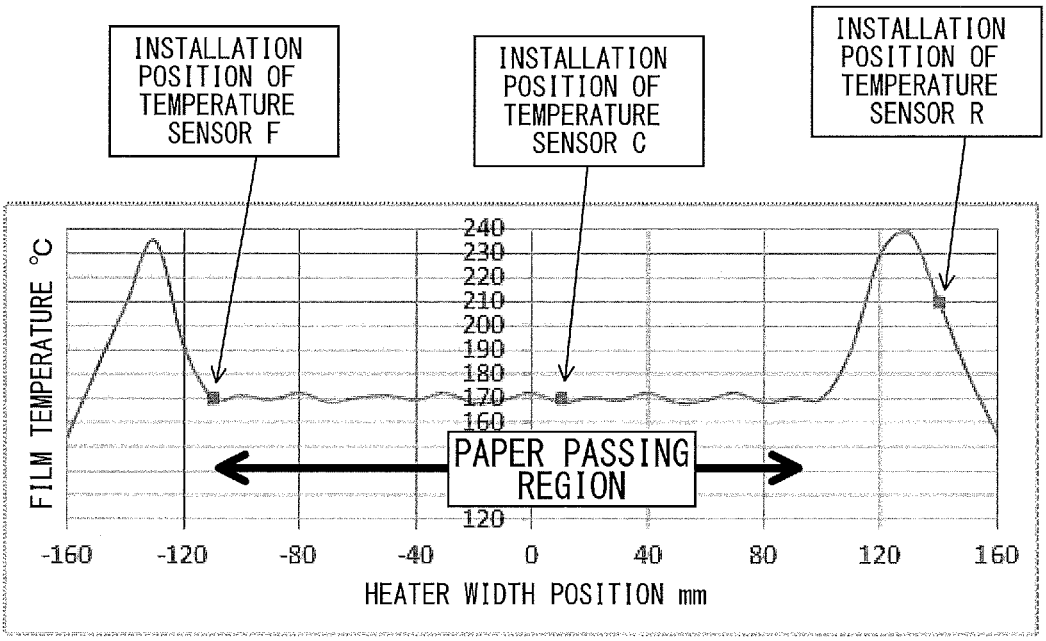
FIG. 11 is a diagram for explaining the temperature distribution of the fixing film in a case where the A4R-sized paper is continuously passed in the conventional image forming apparatus comprising a heater whose heat generation amount orientation is uniform in the width direction.
Figure 12:
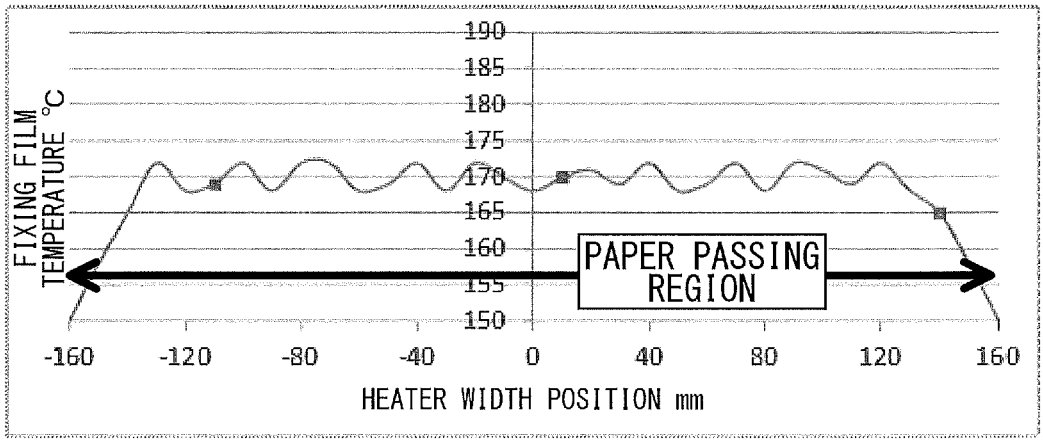
FIG. 12 is a diagram for explaining the temperature distribution of the fixing film in a case where the SRA3-sized paper is continuously passed in the conventional image forming apparatus comprising a heater whose heat generation amount orientation is uniform in the width direction.
Figure 15:
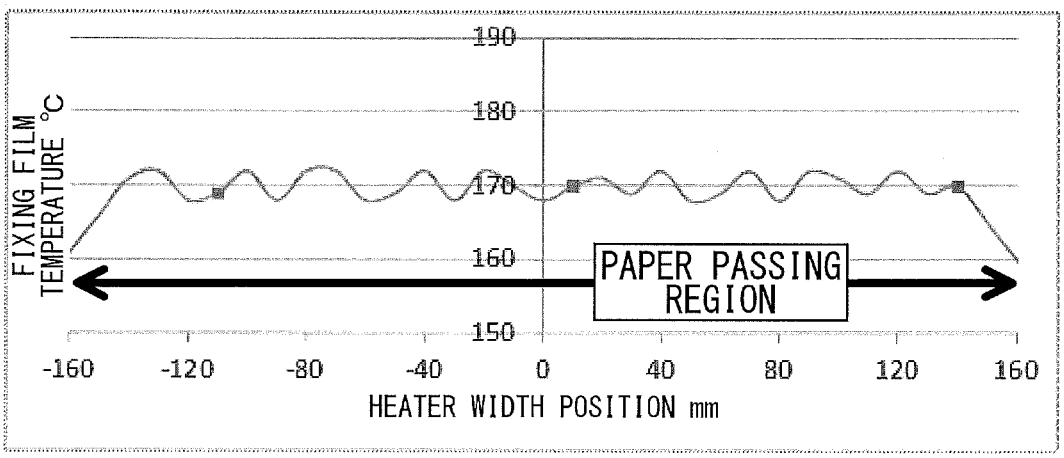
FIG. 15 is a diagram for explaining the temperature distribution of the fixing film in a case where the SRA3-sized paper is continuously passed in the conventional image forming apparatus comprising a heater whose heat generation amount orientation is not uniform in the width direction and which applies the conventional control.

Further, FIG. 10 is a diagram for explaining an example of the temperature distribution of the fixing film in a case where the SRA3-sized paper is continuously passed. In a graph shown in FIG. 10, a temperature drop at the end portion of the paper passing region through the conventional control is about 10° C. (see FIG. 15). On the contrary, it is obvious that there is almost no temperature drop at the end portion of the paper passing region through the control performed by the image forming apparatus 1.

In this manner, with the image forming apparatus 1 according to the present embodiment, it is possible to reduce the local temperature rise of the fixing device and the temperature unevenness in the width direction in the paper passing region.

Further, according to the present embodiment, it is possible to reduce the local temperature rise of the fixing film and the temperature unevenness in the width direction of the paper passing region.

The above embodiments are only the examples to specifically explain the present invention. Therefore, the scope of the invention is not limited to these embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-182895, filed Sep. 16, 2015 which is hereby incorporated by reference herein in its entirety.

What is claimed is:

1. An image forming apparatus comprising:

a fixing film for fixing a toner image formed on a recording material;

first and second fixing heaters configured to heat the fixing film, wherein the first fixing heater has a high heat generation region at a center portion in a width direction of a fixing nip portion and the second fixing heater has a high heat generation region at an end portion in the width direction of the fixing nip portion;

a center portion temperature detection unit configured to detect a center portion temperature of a center portion of the fixing film in the width direction;

an end portion temperature detection unit configured to detect an end portion temperature of an end portion of the fixing film in the width direction;

a size detection unit configured to detect a size of the recording material; and a control unit configured to control a heat generation amount of the first fixing heater and the second fixing heater based on the center portion temperature, the end portion temperature, and the size of the recording material, wherein the control unit is configured:

(i) in a case when the size of the recording material detected by the size detection unit is smaller than a predetermined value, to control heat generation amounts of the first fixing heater and the second fixing heater in a first control mode in which an energization ratio of the first fixing heater is preferentially determined and then an energization ratio of the second fixing heater is determined based on the energization ratio of the first fixing heater, and (ii) in a case when the size of the recording material detected by the size detection unit is larger than the predetermined value, to control heat generation amounts of the first fixing heater and the second fixing heater in a second control mode in which an energization ratio of the first fixing heater and an energization ratio of the second fixing heater are respectively determined based on a difference between the center portion temperature and the end portion temperature.

2. The image forming apparatus according to claim 1, wherein the control unit is configured:

in a case when the width of the recording material is larger than the predetermined value and the end portion temperature is lower than the center portion temperature, to control heat generation amounts of the first fixing heater and the second fixing heater in the second control mode, and in a case when the width of the recording material is larger than the predetermined value and the end portion temperature is higher than the center portion temperature, to control blast generation amounts of the first fixing heater and the second fixing heater in a third control mode.

3. The image forming apparatus according to claim 2, wherein the control unit is further configured, in the second control mode:

to define a value obtained by multiplying a value obtained by subtracting the temperature of the end portion of the fixing film from the temperature of the center portion of the fixing film by a proportional gain as an active ratio, and wherein the control unit is further configured:

to define a value obtained by subtracting the temperature of the center portion of the fixing film from a fixing target temperature as a fixing temperature residual, to determine a fixing heater energization ratio in accordance with the fixing temperature residual, to define a value obtained by subtracting the active ratio from the fixing heater energization ratio as the energization ratio of the first fixing heater, and to define a value obtained by adding the fixing heater energization ratio to the active ratio as the energization ratio of the second fixing heater.

4. The image forming apparatus according to claim 2, further comprising the third control mode through which the heat generation amount of the second fixing heater is reduced, wherein the control unit is further configured to control the first fixing heater and the second fixing heater to heat in the second control mode in a case when the width of the recording material is wider than the predetermined width and the temperature detected by the end portion temperature detection unit is higher than the temperature detected by the center portion temperature detection unit.

5. The image forming apparatus according to claim 4, wherein the control unit is further configured, in the third control mode in which a fixing target temperature is set:

to define a value obtained by subtracting the temperature of the center portion of the fixing film from the fixing target temperature as a fixing temperature residual, to determine a fixing heater energization ratio through PI control in accordance with the fixing temperature residual, to define the fixing heater energization ratio as the energization ratio of the first fixing heater, and to define a value obtained by multiplying the fixing heater energization ratio by a constant ratio gain as the energization ratio of the second fixing heater.

6. The image forming apparatus according to claim 1, wherein the control unit is further configured:

to define a value obtained by subtracting the temperature of the center portion of the fixing film from a fixing target temperature as a fixing temperature residual, to determine a fixing heater energization ratio in accordance with the fixing temperature residual, and to control the heat generation amount of the first fixing heater and the second fixing heater based on the fixing heater energization ratio.

7. The image forming apparatus according to claim 6, wherein the fixing heater energization ratio is determined through PI control in accordance with the fixing temperature residual.

8. The image forming apparatus according to claim 7, wherein the control unit is further configured, in the first control mode, to preferentially determine an energization ratio of the first fixing heater based on the fixing heater energization ratio, and to determine an energization ratio of the second fixing heater based on a difference between the energization ratio of the first fixing heater and the fixing heater energization ratio.

9. The image forming apparatus according to claim 8, wherein the control unit is further configured, in the first control mode:

to define a doubled value of the fixing heater energization ratio as the energization ratio of the first fixing heater, and to define a value obtained by subtracting 100 from the doubled value of the fixing heater energization ratio as the energization ratio of the second fixing heater.

10. The image forming apparatus according to claim 9, wherein the control unit is further configured:

to define the energization ratio of the first fixing heater as 100 in a case where the doubled value of the fixing heater energization ratio is equal to or more than 100, and to define the energization ratio of the second fixing heater as 0 (zero) in a case when a value obtained by subtracting 100 from the doubled value of the fixing heater energization ratio is equal to or less than 0 (zero).

11. The image forming apparatus according to claim 1, wherein a first temperature sensor, a second temperature sensor, and a third temperature sensor, for detecting the temperature of the fixing film, are arranged in order along a direction that is orthogonal to a conveying direction of the recording material, wherein the sensors are arranged so that an interval between the first temperature sensor and the second temperature sensor is shorter than the interval between the second temperature sensor and the third temperature sensor, wherein the second temperature sensor operates as the center portion temperature detection unit, wherein the first temperature sensor operates as the end portion temperature detection unit in a case when the width of the recording material is smaller than a predetermined width, and wherein the third sensor operates as the end portion temperature detection unit in a case when the width of the recording material is wider than the predetermined width.

12. The image forming apparatus according to claim 1, wherein the first fixing heater has a maximum heat gradient at the center portion, and the second fixing heater has the maximum heat gradient at the end portion.

13. A fixing device comprising:

a fixing film for heating a toner image formed on a recording material to be fixed by heat;

a first fixing heater for heating the fixing film and having a high heat generating region at a center portion;

a second fixing heater for heating the fixing film and having a high heat generating region at an end portion;

a center portion temperature detection unit configured to detect a temperature of a center portion of the fixing film;

an end portion temperature detection unit configured to detect a temperature of an end portion of the fixing film;

a size detection unit configured to detect a size of the recording material; and a control unit configured to control a heat generation amount of the first fixing heater and the second fixing heater based on the temperature detected by the center portion temperature detection unit, the temperature detected by the end portion temperature detection unit, and the size of the recording material, wherein the control unit is configured:

(i) in a case when the size of the recording material detected by the size detection unit is smaller than a predetermined value, to control heat generation amounts of the first fixing heater and the second fixing heater in a first control mode in which an energization ratio of the first fixing heater is preferentially determined and then an energization ratio of the second fixing heater is determined based on the energization ratio of the first fixing heater, and (ii) in a case when the size of the recording material detected by the size detection unit is larger than the predetermined value, to control heat generation amounts of the first fixing heater and the second fixing heater in a second control mode in which an energization ratio of the first fixing heater and an energization ratio of the second fixing heater are respectively determined based on a difference between the center portion temperature and the end portion temperature.

* * * * *